US008101877B2

(12) United States Patent
Rowntree

(10) Patent No.: US 8,101,877 B2
(45) Date of Patent: Jan. 24, 2012

(54) ROTATING DUAL SWITCHING MECHANISM

(75) Inventor: David Rowntree, Durham (GB)

(73) Assignee: Black & Decker Inc., Newark, DE (US)

( * ) Notice: Subject to any disclaimer, the term of this patent is extended or adjusted under 35 U.S.C. 154(b) by 570 days.

(21) Appl. No.: 12/243,054

(22) Filed: Oct. 1, 2008

(65) Prior Publication Data

US 2009/0090609 A1 Apr. 9, 2009

(30) Foreign Application Priority Data

Oct. 9, 2007 (EP) ..... 07118099

(51) Int. Cl.
*H01H 19/58* (2006.01)

(52) U.S. Cl. ..... 200/14; 200/18

(58) Field of Classification Search ..... 200/14
See application file for complete search history.

(56) References Cited

U.S. PATENT DOCUMENTS 4,288,665 A * 9/1981 Smith ..... 200/18
6,049,044 A * 4/2000 Mizobuchi ..... 200/4
6,124,555 A * 9/2000 Isikawa ..... 200/4
6,365,855 B1 * 4/2002 Sutter et al. ..... 200/314
6,555,770 B2 * 4/2003 Kawase ..... 200/18
6,943,305 B2 * 9/2005 Kawamura et al. ..... 200/4
2005/0067263 A1 3/2005 Kawamura et al.

FOREIGN PATENT DOCUMENTS

WO 2005070722 8/2005

* cited by examiner

*Primary Examiner* — Elvin G Enad
*Assistant Examiner* — Lisa Homza
(74) *Attorney, Agent, or Firm* — John Yun

(57) ABSTRACT

The present invention provides a rotating dual switching mechanism having a first switch and a first activator with rotational axis, and a second switch having a second activator that is offset from the rotational axis. A ring-shaped actuator is concentric with the rotational axis and is movable to actuate the second activator. A switch arm is rotatable about the rotation axis and has a first portion that actuates the first activator and a second portion for engaging and the ring-shaped actuator and hence the second activator. The switch arm is movable to a first position where both the first and second activator are "off," a second position where the first activator is "on" and the second activator is "off," and a third position where both the first and second activator are "on."

7 Claims, 9 Drawing Sheets

ROTATING DUAL SWITCHING MECHANISM

CROSS-REFERENCE TO RELATED APPLICATION

This application claims priority to European Patent Application No. 07118099.6 filed Oct. 9, 2007. The entire contents of that application are expressly incorporated herein by reference.

BACKGROUND OF THE INVENTION

The present invention concerns a rotating dual switching mechanism. A dual switching mechanism is one in which two electrical circuits each comprise a respective switch which may be switched between an "off" state thereof and an "on" state thereof using only a single controller. For example, in a domestic vacuum cleaner, there may be a first electrical circuit having a first switch for providing power to a first motor which drives a fan to generate suction in the vacuum cleaner and a second electrical circuit having a second switch for providing power to a second, smaller motor for driving a beater brush in the floorhead of the vacuum cleaner. In such a case, it would be desirable for a user of the vacuum cleaner to be able to switch both the first motor on and off and the second motor on and off using a dual switching mechanism comprising only a single controller, such as a single button or slider. For example, if the controller of the dual switching mechanism is a slider, the slider could have three positions: a first position in which both motors are put in the "off" state, a second position in which the first motor which drives the fan to generate suction in the vacuum cleaner is put in the "on" state, but the second motor which drives the beater brush remains in the "off" state, and a third position in which both the fan motor and the beater brush motor are put into the "on" state.

BRIEF SUMMARY OF THE INVENTION

However, again considering the same example of a vacuum cleaner, if the first and second motors and the first and second switches for operating the respective motors are located in a lower part of the vacuum cleaner, in order to avoid the vacuum cleaner from becoming top-heavy, whereas the controller for the dual switching mechanism is located in an upper part of the vacuum cleaner, so as to be easily accessible to a user, if the vacuum cleaner has a pivot point or rotation axis between the location of the first and second switches on the one hand and the controller of the dual switching mechanism on the other, then some sort of connection must be provided between the controller on the one hand and the switches on the other, which connection is able to accommodate the rotation of the vacuum cleaner about the pivot point. This presents a technical problem, because if, for example, the connection between the controller on the one hand and the switches on the other is provided by means of electrical wires, the wires risk becoming tangled, or strained and accidentally disconnected from the switches, crossed, fatigued by repeated twisting, or otherwise affected by the rotation of the vacuum cleaner about the pivot point.

An object of the present invention is therefore to address this technical problem. A further object of the invention is to provide a dual switching mechanism which can be operated by a single controller, regardless of the orientation of the controller relative to an axis of rotation of the dual switching mechanism; in other words, to provide an effective rotating dual switching mechanism.

Accordingly, in a first aspect, the present invention provides a rotating dual switching mechanism comprising: a first switch having an activator movable between an "on" state and an "off" state, said activator being located on a rotation axis; a second switch having an activator also movable between an "on" state and an "off" state, said activator being offset from said rotation axis; a ring-shaped actuator concentric with the rotation axis and movable between a first position operable to put the activator of the second switch into the "off" state thereof and a second position operable to put the activator of the second switch into the "on" state thereof; and a switch arm having a first portion for changing the state of the activator of the first switch and a second portion for moving the ring-shaped actuator between the first and second positions thereof, the switch arm being rotatable about the rotation axis and movable between a first position operable to put the activator of the first switch in the "off" state thereof and the ring-shaped actuator in the first position thereof, a second position operable to put the activator of the first switch in the "on" state thereof and the ring-shaped actuator in the first position thereof, and a third position operable to put the activator of the first switch in the "on" state thereof and the ring-shaped actuator in the second position thereof.

In a second aspect, the present invention also provides a rotating dual switching mechanism comprising: a first switch having an activator movable between an "on" state and an "off" state, said activator being located on a rotation axis; a second switch having an activator also movable between an "on" state and an "off" state, said activator being offset from said rotation axis; a ring-shaped actuator concentric with the rotation axis and movable between a first position operable to put the activator of the second switch in the "off" state thereof and a second position operable to put the activator of the second switch in the "on" state thereof; and a switch arm having a first portion for changing the state of the activator of the first switch and a second portion for moving the ring-shaped actuator between the first and second positions thereof, the switch arm being rotatable about the rotation axis and movable between a first position operable to put the activator of the first switch in the "off" state thereof and the ring-shaped actuator in the first position thereof, a second position operable to put the activator of the first switch in the "off" state thereof and the ring-shaped actuator in the second position thereof, and a third position operable to put the activator of the first switch in the "on" state thereof and the ring-shaped actuator in the second position thereof.

Thus, both the first and second aspects of the invention allow the activators of the first and second switches to be operated between their "on" and "off" states by movement of the switch arm, even though the switch arm is rotatable about the rotation axis. The switch arm can in turn be mechanically connected in a very simple fashion to a controller for the operating the dual switching mechanism. For example, if the controller is a slider having three possible positions, respective ones of which correspond to the three positions of the switch arm, the slider may be connected to the switch arm simply by means of a push-rod. However, although the switch arm is rotatable about the rotation axis, since the activator of the first switch lies on the rotation axis and the ring-shaped actuator for the activator of the second switch is also concentric with the rotation axis, the orientation of the switch arm relative to the rotation axis does not affect the operability of the switches, and the switches may therefore still be operated with the switch arm oriented at any angle. Moreover, the first and second switches may remain in their fixed locations as the angle of the switch arm varies relative to them, which means that any wires connected to the first and second switches may also remain in their predetermined locations and will not become tangled, accidentally disconnected from the switches, crossed or otherwise affected by the rotation of the switch arm.

The two aspects of the invention are unified by the common inventive concept that they both provide a rotating dual switching mechanism which sequentially places the activators of the first and second switches into the both "off", one "off" and one "on", and both "on" states, regardless of the angle of the switch arm relative to the rotation axis. The only difference between the two aspects of the invention is that in the first aspect of the invention, when the switch arm is moved from a position in which the activators of both the first and second switches are in the "off" state, movement of the switch arm places the activator of the first switch into the "on" state before the activator of the second switch, whereas in the second aspect of the invention, it places the activator of the second switch into the "on" state before the activator of the first switch.

Preferably, the ring-shaped actuator has a radius substantially the same as the offset of the activator of the second switch from the rotation axis. This means that the ring-shaped actuator is located directly above the activator of the second switch, which allows the ring-shaped actuator to act directly on the activator of the second switch without the mediation of an additional component, thereby keeping the cost and complexity of the switching mechanism to a minimum.

Desirably, the ring-shaped actuator should also be movable parallel to the rotation axis. This means that regardless of the orientation of the switch arm and therefore the location at which the second portion of the switch arm acts upon the ring-shaped actuator to move it between its first and second positions, the action of the ring-shaped actuator in turn on the activator of the second switch as a result of this is always identical, thereby ensuring reliable and repeatable operation of the second switch.

The ring-shaped actuator may also be a split ring comprising a hiatus located across a radius orthogonal to said rotation axis. Provided that the hiatus is also at a location different from the location of the activator of the second switch (in which case the ring-shaped actuator would be unable to act upon the activator of the second switch), this hiatus can be used to accommodate stresses placed on the ring-shaped actuator by the motion of the switch arm.

In order to ensure even movement of the ring-shaped actuator, the switch arm is preferably provided with a third portion which operates in concert with the second portion of the switch arm to move the ring-shaped actuator between the first and second positions thereof. Thus, the second and third portions of the switch arm may act simultaneously on the ring-shaped actuator across a diameter of the actuator, encouraging its movement to be parallel to the rotation axis, which has the advantages in operation of the second switch already described above.

The switch arm may be of any shape, may comprise more than one component and may move in a variety of different directions, but the simplest alternative is that the switch arm is movable between the first, second and third positions thereof by sliding along a radius orthogonal to said rotation axis. This helps to keep the cost and complexity of the switching mechanism to a minimum.

Preferably, the switch arm is spring-loaded in a direction parallel to the rotation axis towards the activator of the first switch. This helps to ensure that the activator of the first switch is always operated reliably and repeatably when the switch arm moves into a position that places the activator in its "on" state. The ring-shaped actuator may also be spring-loaded in a direction parallel to the rotation axis away from the activator of said second switch. This helps to ensure that the activator of the second switch does not become latched in the "on" state as a result of the failure of the ring-shaped actuator to move from its second to its first position after the switch arm has moved to a position operable to put the ring-shaped actuator in the first position thereof. In either case, the spring-loading of the switch arm and/or of the ring-shaped actuator may be achieved by providing one or both of these components with a living spring formed integrally therewith. This helps to reduce the total number of component parts of the switching mechanism, thereby also keeping its cost and complexity to a minimum. Alternatively, coil or leaf springs may be used instead.

Ordinarily, the switch arm is free to rotate about the rotation axis through any angle, even by more than 360 degrees. However, if the switch arm is provided with a fourth portion for abutment against an end stop, the range of rotation of the switch arm may be limited to less than 360 degrees. Typically this fourth portion would be provided on a side of the switch arm. If a further fifth portion for abutment against a second end-stop is then also provided on the opposite side of the switch arm form the fourth portion, the rotation of the switch arm may be contained within a range defined by the two opposing end stops. This range may be of any angle, depending on the location of the end stops, for example 90, 120, 180 or 270 degrees.

The first portion of the switch arm may change the state of the first switch by acting on the activator of the first switch directly. However, this has the disadvantage that the first portion of the switch arm will therefore tend to engage the activator in a sideways movement, which is not conducive to movement of the activator between the "on" and "off" states thereof in directions parallel and anti-parallel to the rotation axis, and which may result in damage of the first switch and its failure to operate correctly after repeated operations. Preferably, therefore, the switching mechanism further comprises an actuator located between the first portion of the switch arm and the activator of the first switch, which further actuator is movable between a first position operable to put the activator of said first switch in the "off" state thereof and a second position operable to put the activator of said first switch in the "on" state thereof. Thus although the switch arm may continue to act on the further actuator in a sideways movement, the further actuator in turn acts on the activator of the first switch in a movement which is parallel to the rotation axis, thereby helping to preserve the functionality of the first switch. The further actuator may also be spring-loaded in a direction parallel to the rotation axis away from the activator of the first switch, in order to ensure that the first switch does not become latched in the "on" state thereof as a result of the failure of the further actuator to move from its second to its first position, even when the switch arm has been moved to a position operable to put the further actuator in the first position thereof. The spring-loading may be achieved by providing further actuator with a living spring formed integrally therewith, thereby helping to keep the cost and complexity of the switching mechanism to a minimum. Alternatively, coil or leaf springs may be used instead.

In a preferred embodiment, the present invention provides a vacuum cleaner comprising a rotating dual switching mechanism according to either the first or the second aspect of the invention.

BRIEF DESCRIPTION OF THE DRAWINGS

Further features and advantages of the present invention will be better understood by reference to the following detailed description, which is given by way of example and in association with the accompanying drawings, in which.

DETAILED DESCRIPTION OF THE INVENTION

Figure 1:
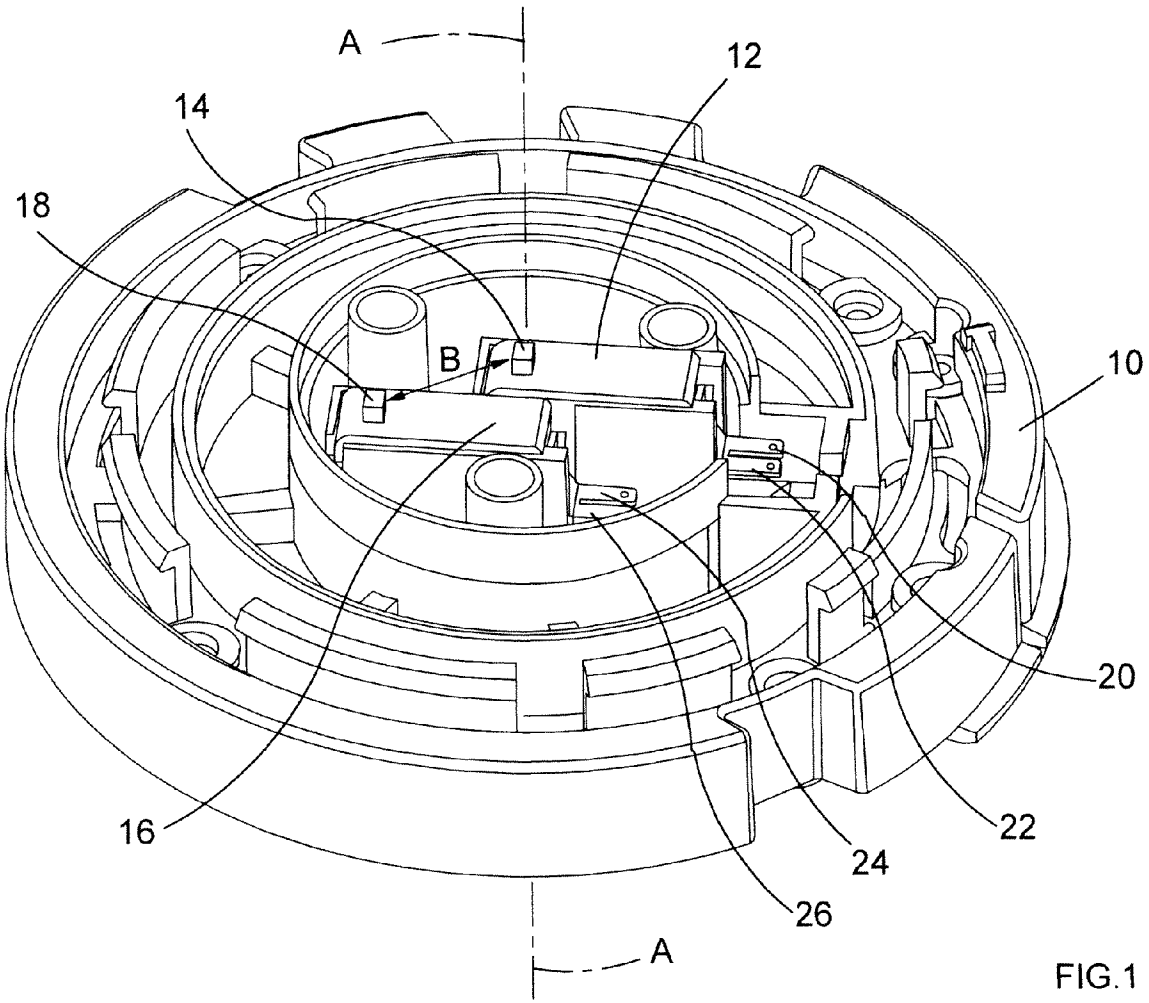
FIG. 1 is a perspective view of a base part of a rotating dual switching mechanism according to an embodiment of the invention.

Referring firstly to FIG. 1, there is shown a base part 10 of a rotating dual switching mechanism according to an embodiment of the invention. Mounted on the base part 10 is a first switch 12 having an activator 14 located on a rotation axis A. The activator 14 is spring-loaded and is movable between a first, depressed position, in which it is in an "on" state, and a second, undepressed position, in which it is in an "off" state. Also mounted on the base part 10 is a second switch 16 having an activator 18 at a location offset from rotation axis A by an amount B. Like the activator 14 of first switch 12, the activator 18 of second switch 16 is also spring-loaded and is movable between a first, depressed position, in which it is in an "on" state, and a second, undepressed position, in which it is in an "off" state. Both of switches 12 and 16 are provided with respective pairs of electrical terminals 20, 22 and 24, 26 for connection of electrical wires to said switches as part of two respective electrical circuits. Thus, the first switch 12 completes a first electrical circuit when the activator 14 is in the "on" state thereof, and the second switch 16 completes a second electrical circuit when the activator 18 is in the "on" state thereof.

Figure 2:
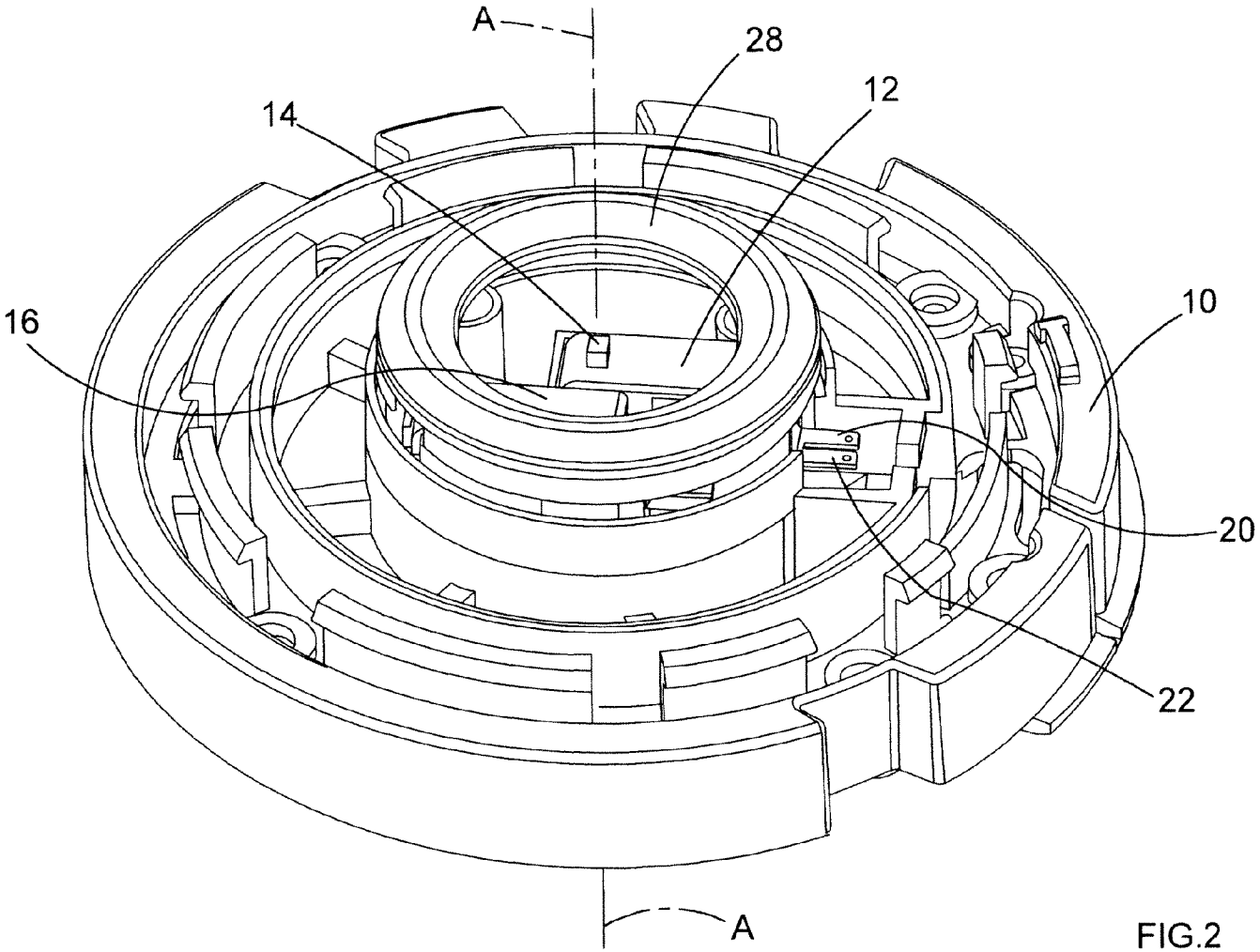
FIG. 2 is a perspective view of a ring-shaped actuator mounted on the base part of FIG. 1 in a first position of said actuator.

FIG. 2 shows a ring-shaped actuator 28 mounted on the base part 10. As may be seen, the ring-shaped actuator 28 is concentric with the rotation axis A and has a radius substantially the same as the offset B of the activator 18 of the second switch 16 from the rotation axis A. The ring-shaped actuator 28 is also movable between a first, undepressed position operable to put the activator 18 of the second switch 16 in the "off" state thereof, and a second, depressed position operable to put the activator 18 of the second switch 16 in the "on" state thereof. FIG. 2 shows the ring-shaped actuator 28 in the first, undepressed position of said actuator.

Figure 3:
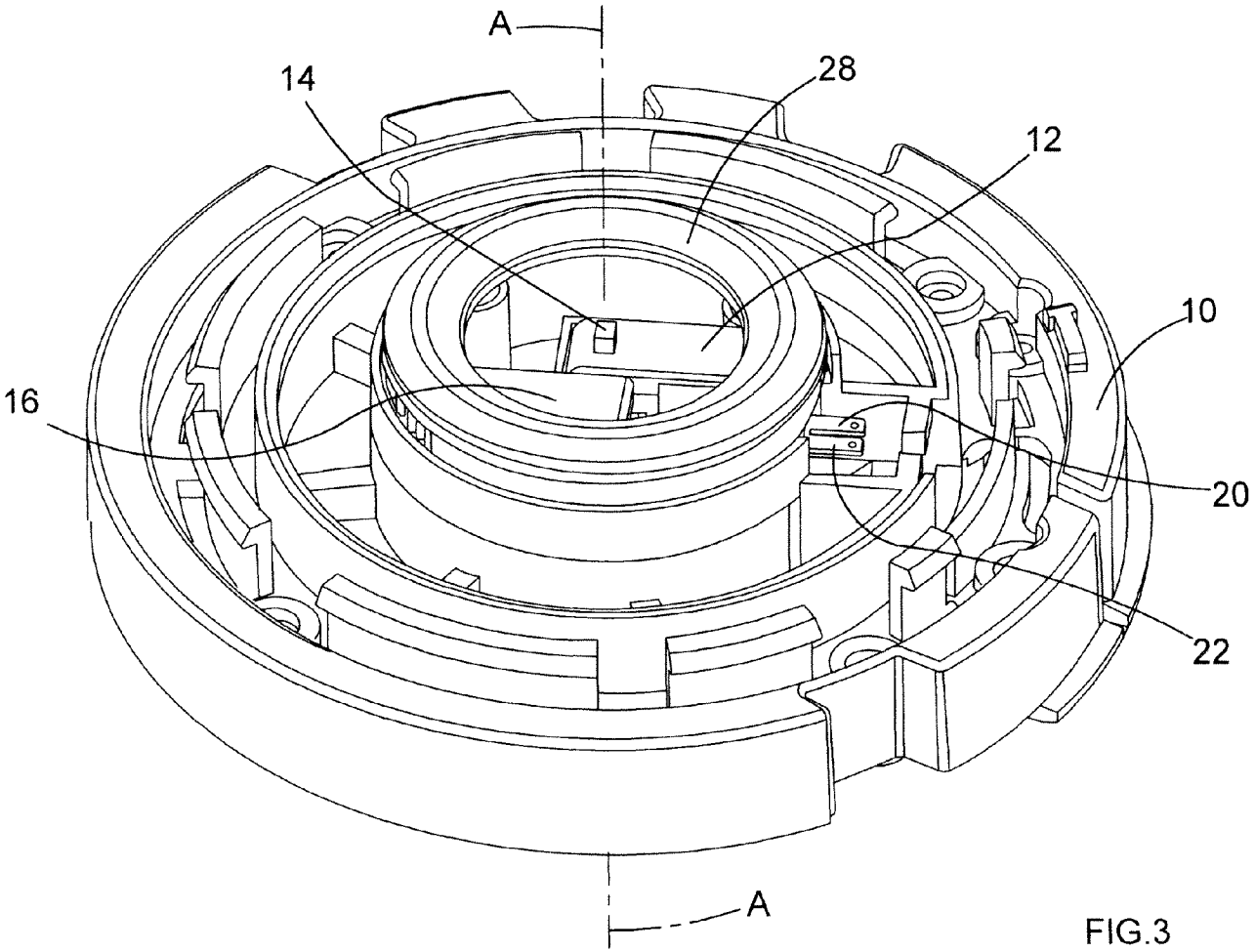
FIG. 3 is a perspective view of the ring-shaped actuator mounted on the base part of FIG. 1 in a second position of said actuator.
Figure 4:
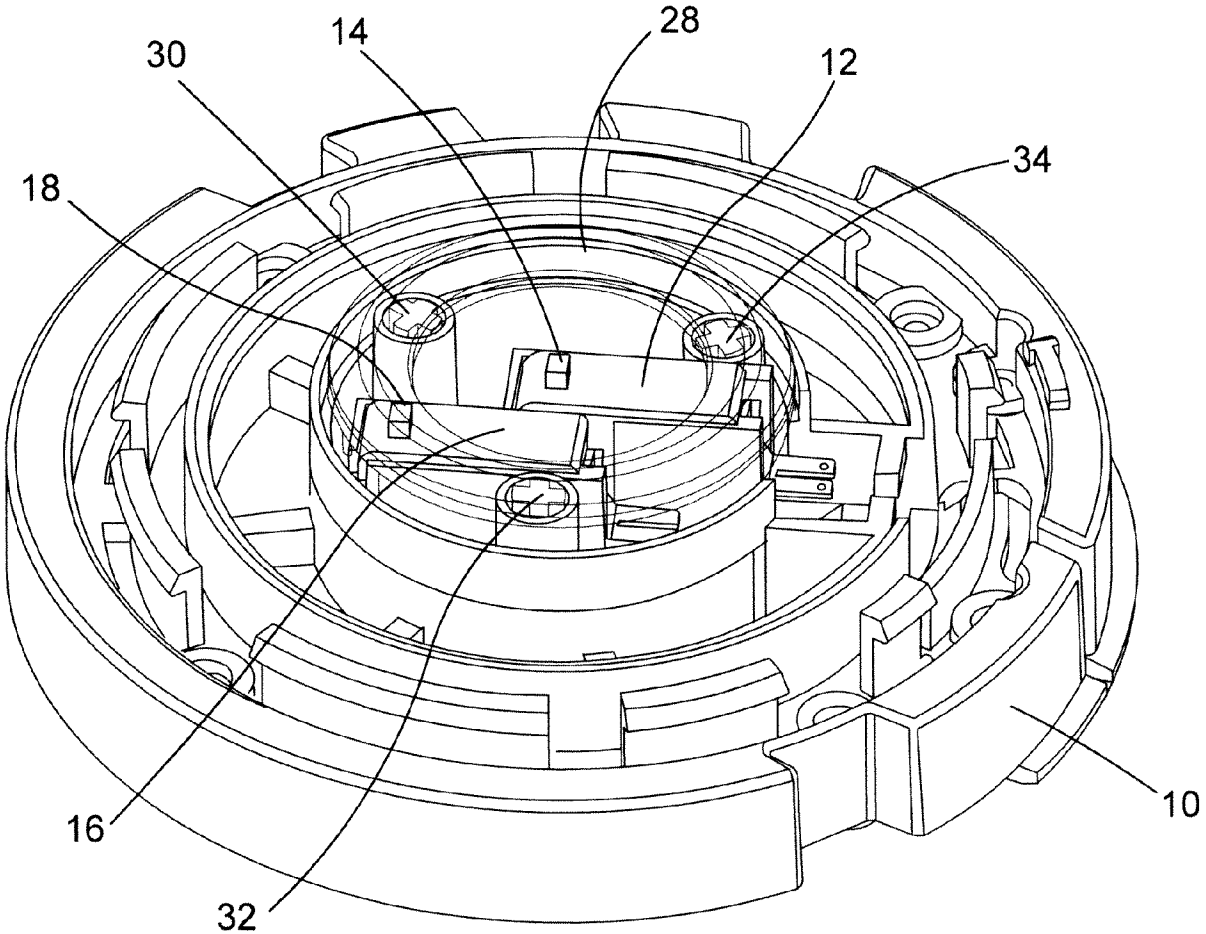
FIG. 4 is a perspective view the same as FIG. 3, except that the ring-shaped actuator has been rendered transparent for ease of viewing.

FIG. 3 is the same as FIG. 2, except that it shows the ring-shaped actuator 28 in the second, depressed position of said actuator, whereas FIG. 4 is the same as FIG. 3, except that the ring-shaped actuator 28 has now been rendered transparent, in order to show how the underside of ring-shaped actuator 28 acts to depress activator 18 of second switch 16 into the "on" state thereof. Also visible in FIG. 4 are three mounting points 30, 32, 34 provided on base part 10 for compression springs, which act in concert with each other to return actuator 28 from the second, depressed position thereof to the first, undepressed position thereof. The locations of the three mounting points at equal intervals around the rotation axis A help to ensure that the ring-shaped actuator 28 moves parallel to the rotation axis.

Figure 5:
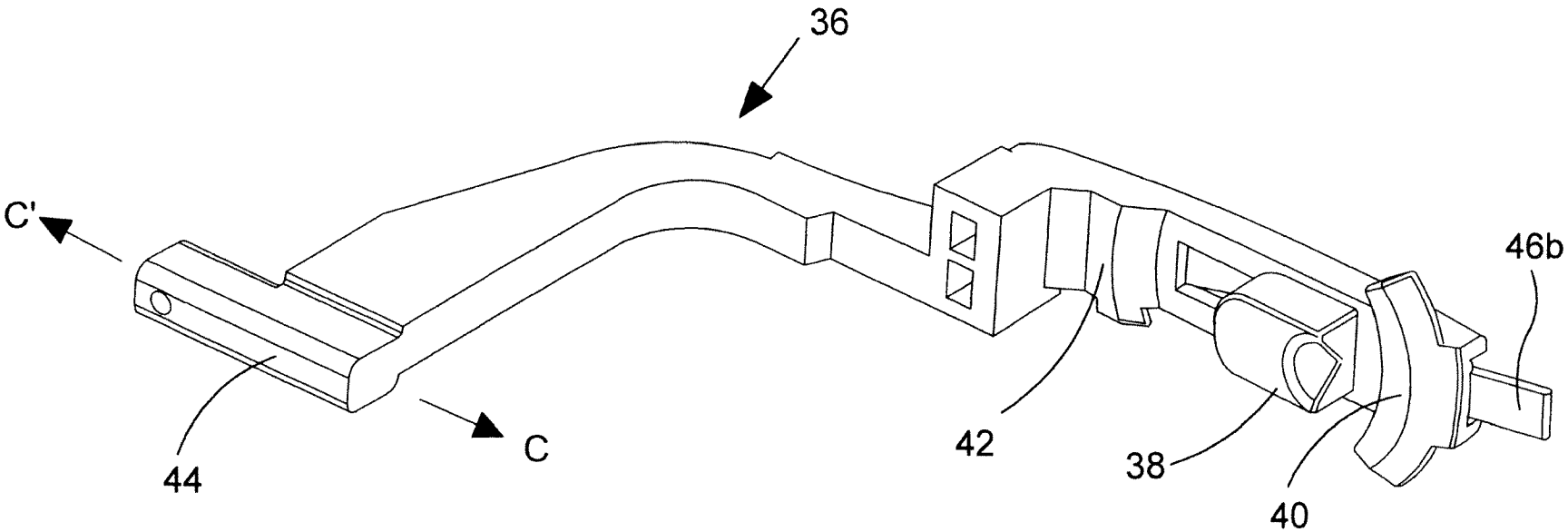
FIG. 5 is perspective view of a switch arm of the rotating dual switching mechanism according to an embodiment of the invention.

FIG. 5 shows a switch arm 36 of the rotating dual switching mechanism. The switch arm 36 has a first portion 38 for changing the state of the activator 14 of the first switch 12, and second and third portions 40, 42, which operate in concert with each other to move the ring-shaped actuator 28 between its first, undepressed position and its second, depressed position. The switch arm 36 is rotatable about the rotation axis A into any orientation orthogonal thereto. A distal end 44 of the switch arm 36 connects to a slider (not shown), by which a user may move the switch arm back and forth in the directions indicated by the double-headed arrow C-C' in FIG. 5.

Figure 6A:
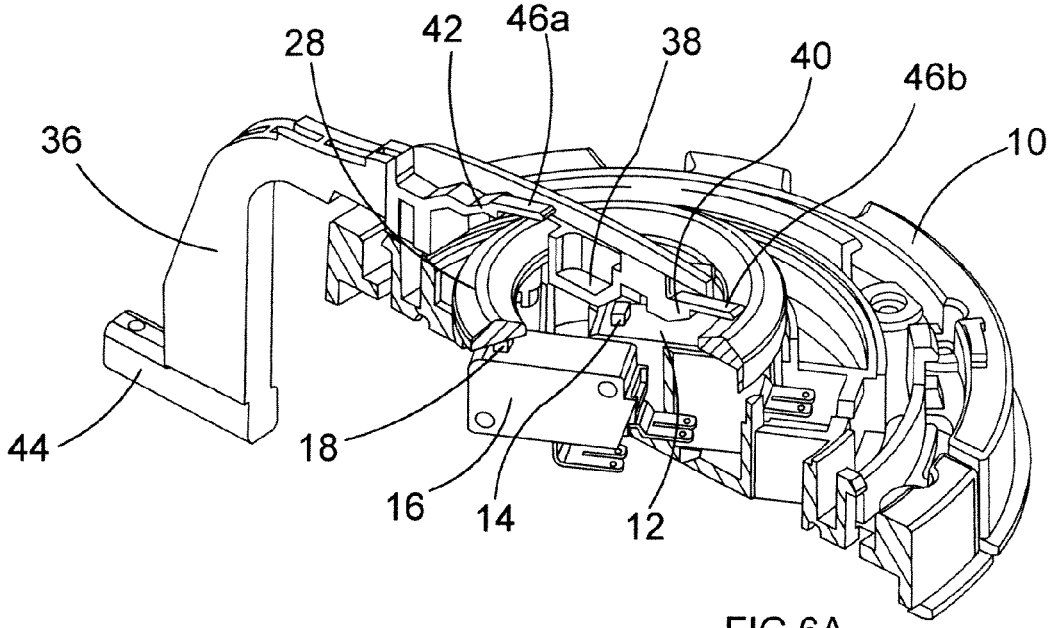
FIG. 6A is a partially cut-away perspective view of the switch arm of FIG. 5 mounted on the base part of FIG. 1 and the ring-shaped actuator of FIGS. 2 to 4 in a first position of said switch arm.
Figure 6B:
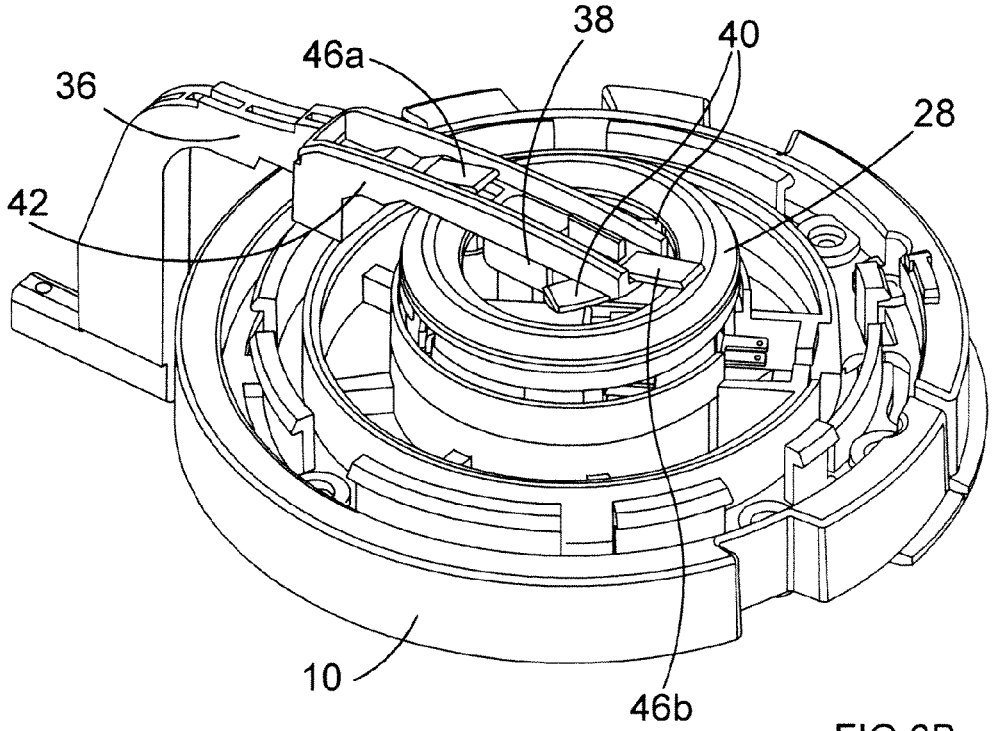
FIG. 6B is a perspective view the same as FIG. 6A, except that the partial cut-away has been omitted.

FIG. 6A shows the switch arm 36 and the ring-shaped actuator 28 mounted on the base part 10 in a first position of the switch arm 36, in which the first portion 38 of the switch arm is out of engagement with the activator 14 of the first switch 12, and the second and third portions 40, 42 of the switch arm 36 are also out of engagement with the ring-shaped actuator 28. Consequently, the activator 14 of the first switch 12, being spring-loaded into its undepressed position, is in the "off" state and the ring-shaped actuator 28 is also returned to its first, undepressed position by the combined action of the compression springs located in mounting points 30, 32, 34. As a result, ring-shaped actuator 28 is also out of engagement with the activator 18 of second switch 16, which being spring-loaded into its undepressed position, is also in the "off" state. FIG. 6B shows the same overall condition of both the first and the second switches 12, 16 being in the "off" state, except without the partial cut-away of FIG. 6A.

Figure 7A:
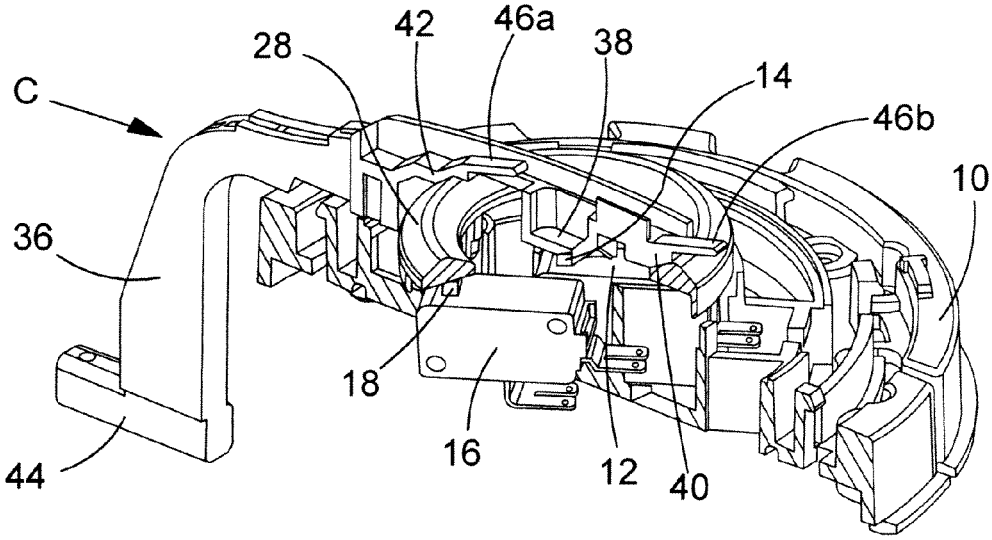
FIG. 7A is a partially cut-away perspective view of the switch arm of FIG. 5 mounted on the base part of FIG. 1 and the ring-shaped actuator of FIGS. 2 to 4 in a second position of said switch arm.
Figure 7B:
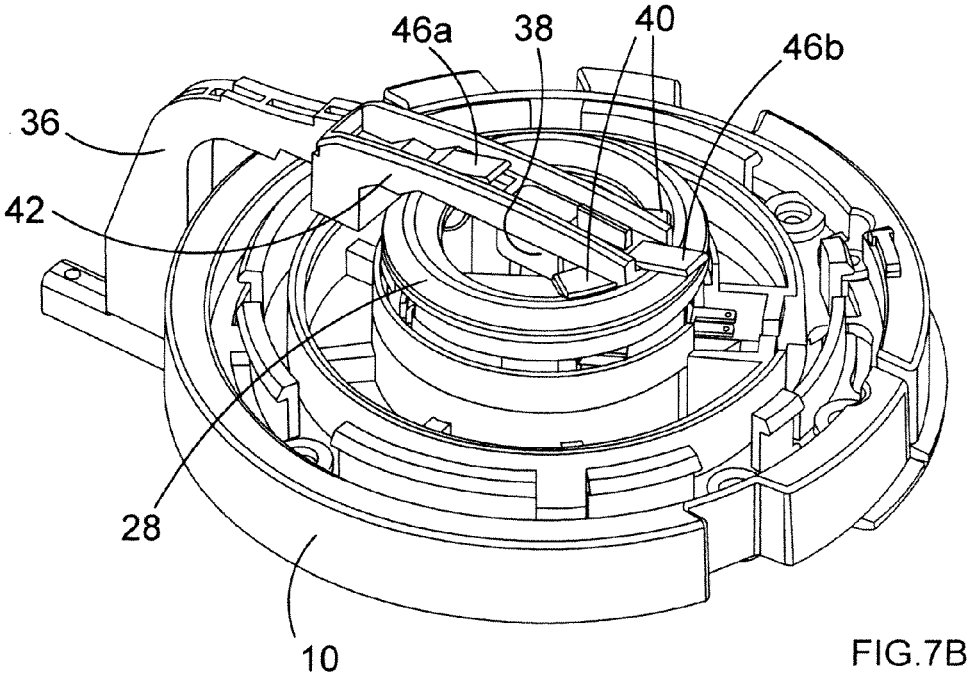
FIG. 7B is a perspective view the same as FIG. 7A, except that the partial cut-away has been omitted.

FIG. 7A shows what happens when the switch arm 36 is moved from the first position of FIGS. 6A and 6B in the direction of arrow C into a second position, in which a leading, bevelled edge of the first portion 38 of the switch arm engages and depresses the activator 14 of the first switch 12 into the "on" state thereof. However, it may also be seen that in this second position of switch arm 36, the second and third portions 40, 42 of the switch arm 36 are merely touching, but failing to depress the ring-shaped actuator 28. Consequently, the ring-shaped actuator 28 remains in its first, undepressed position under the combined action of the compression springs located in mounting points 30, 32, 34, and the activator 18 of second switch 16 also remains in the "off" state thereof. FIG. 7B shows the same overall condition of the first switch 12 being in the "on" state, but the second switch 16 being in the "off" state, except without the partial cut-away of FIG. 7A.

Figure 8A:
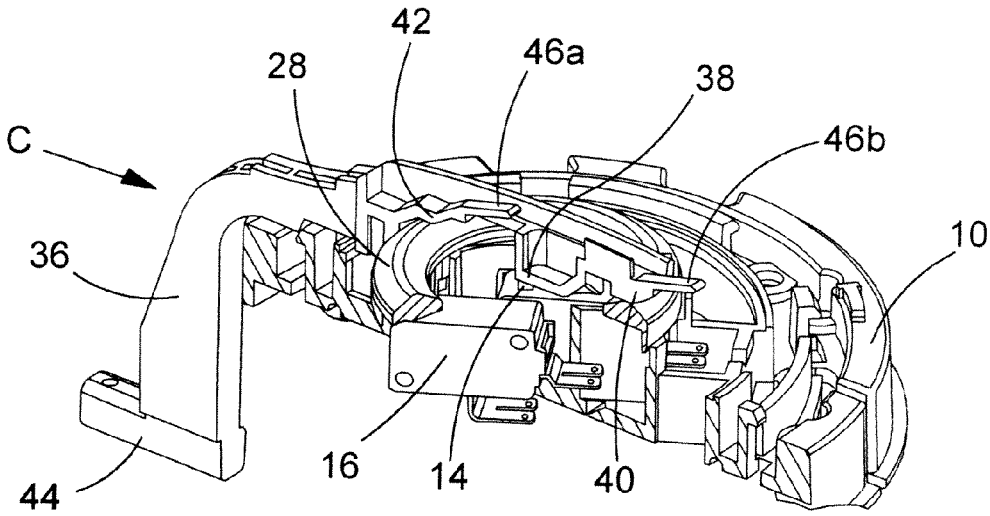
FIG. 8A is a partially cut-away perspective view of the switch arm of FIG. 5 mounted on the base part of FIG. 1 and the ring-shaped actuator of FIGS. 2 to 4 in a third position of said switch arm.
Figure 8B:
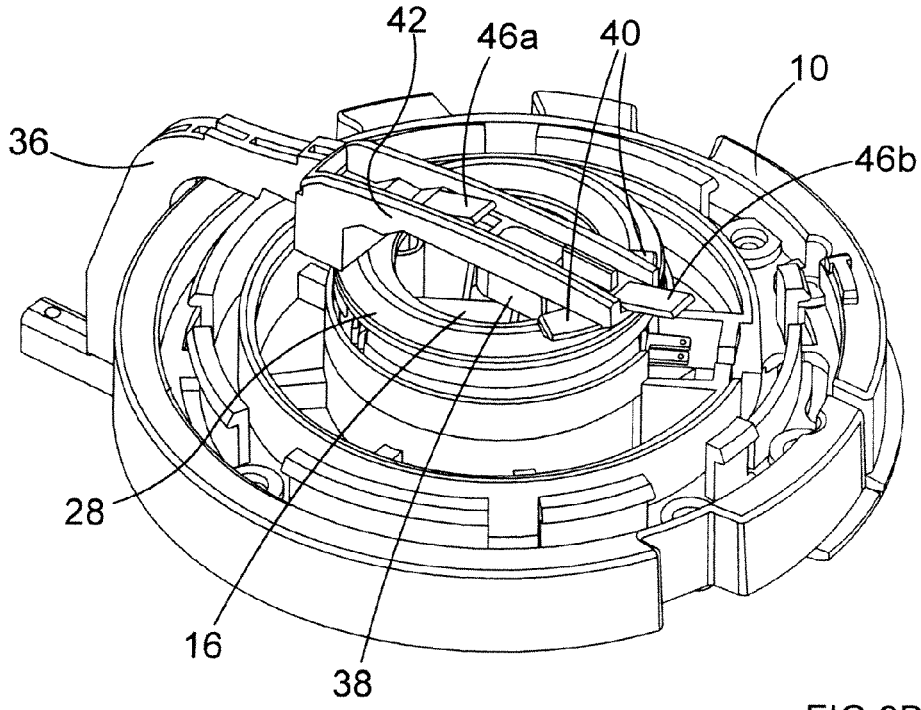
FIG. 8B is a perspective view the same as FIG. 8A, except that the partial cut-away has been omitted.

FIG. 8A shows what happens when the switch arm 36 is moved from the second position of FIGS. 7A and 7B again in the direction of arrow C into a third position, in which the first portion 38 of the switch arm has ridden over the activator 14 of the first switch 12 and continues to hold it down in the depressed "on" state. In this third position of switch arm 36, the second and third portions 40, 42 of the switch arm 36 have also ridden over and depressed the ring-shaped actuator 28 into its second, depressed position, against the combined action of the compression springs located in mounting points 30, 32, 34. As a result, the ring-shaped actuator 28 also engages with the activator 18 of second switch 16 and depresses it into the "on" state thereof. FIG. 8B shows the same overall condition of both the first and the second switches 12, 16 being in the "on" state, except without the partial cut-away of FIG. 8A. Reversing the movement of switch arm 36 in the direction of arrow C' and opposite to arrow C has the effect of reversing the overall condition of the switching mechanism from that shown in FIGS. 8A and 8B, back to the overall condition shown in FIGS. 7A and 7B, and thence back to the overall condition shown in FIGS. 6A and 6B again, under the action of the compression springs located in mounting points 30, 32, 34 and the spring-loading of the activators 14, 18 of the two switches 12, 16.

Figure 9:
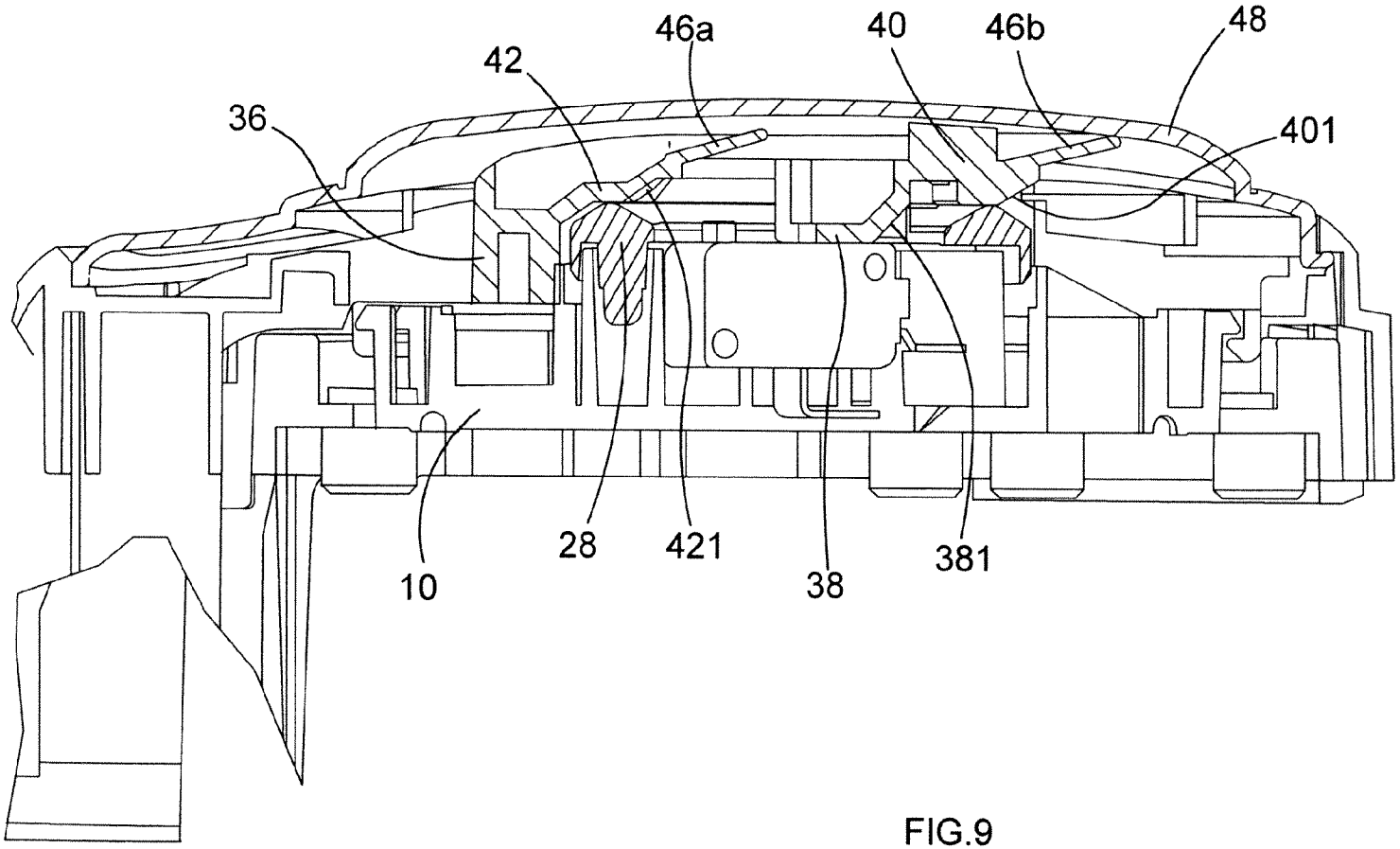
FIG. 9 is a longitudinal sectional view of the rotating dual switching mechanism of this embodiment.

Finally, FIG. 9 shows a longitudinal section through the rotating dual switching mechanism of this embodiment. As can be seen from FIG. 9, the switch arm 36 is spring-loaded in a direction parallel to the rotation axis A towards the activator 14 of the first switch 12 by being provided with a pair of living springs 46*a*, 46*b* formed integrally therewith, which abut against a cap part 48 of the switching mechanism. These living springs 46*a*, 46*b* prevent the ring-shaped actuator 28 and the activator 14 of the first switch 12 from returning to their undepressed states when acted upon by the switch arm 36 under the respective actions of the three compression springs located in mounting points 30, 32, 34 and the spring-loading of the activator 14. FIG. 9 also shows more clearly the bevelled leading edge 381 of the first portion 38 of the switch arm 36, which helps switch arm 36 to engage smoothly with activator 14. Similarly, the second and third portions 40, 42 of the switch arm 36 are both also provided with respective bevelled leading edges 401, 421 which help switch arm 36 to engage smoothly with ring-shaped actuator 28, which in turn, as may also be seen most clearly in FIG. 9, is itself provided with a substantially triangular-shaped profile for the same reason. As a result of this triangular profile, the bevelled leading edges 401, 421 of switch arm 36 engage face-to-face with ring-shaped actuator 28. The location of second and third portions 40, 42 of switch arm 36 across a diameter of the ring-shaped actuator 28 also help to ensure even movement of the ring-shaped actuator parallel and anti-parallel to the rotation axis A. The operation of the bevelled leading edge 381 of the first portion 38 of switch arm 36 on the activator 14 of first switch 12 may also be made to act more evenly by providing a further triangular-shaped actuator between the first portion 38 of the switch arm and the activator 14, such that the bevelled leading edge 381 engages face-to-face therewith, although such a further actuator is not represented in the illustrated embodiment.

Whether or not the first portion 38 of the switch arm engages the activator 14 of the first switch 12 before the second and third portions 40, 42 of the switch arm engage the ring-shaped actuator 28 when the switch arm is moved in the direction of arrow C, and therefore whether or not the first switch is put into the "on" state before the second switch, is determined only by the location on switch arm 36 of the first portion 38 relative to the second and third portions 40, 42. Thus, in an alternative possible embodiment from that illustrated in the accompanying drawings, the first portion 38 of the switch arm 36 may be located further from the second portion 40 and nearer to the third portion 42 than is illustrated in the drawings, whilst the separation between the second and third portions 40, 42 themselves remains the same. In this alternative case, the second and third portions 40, 42 will engage the ring-shaped actuator 28 before the first portion 38 engages the activator 14 of the first switch 12, and hence the second switch 16 will be depressed into the "on" state before the first switch 12 when the switch arm is moved in the direction of arrow C. Otherwise however, this alternative possible embodiment is constructed and functions in all respects in the same manner as the embodiment illustrated in the accompanying drawings.

The invention claimed is:

1. A rotating dual switching mechanism comprising:

a first switch (12) having a first activator (14) movable between an "on" state and an "off" state, said first activator (14) being located on a rotation axis (A);

a second switch (16) having a second activator (18) movable between an "on" state and an "off" state, said second activator (18) being offset (B) from said rotation axis (A);

a ring-shaped actuator (28) concentric with said rotation axis (A) and movable in a direction parallel to the rotation axis between a first position operable to put the second activator (18) in the "off" state thereof and a second position operable to put the second activator (18) in the "on" state thereof; and a switch arm (36), separate from and extending across the ring-shaped actuator, having a first portion (38) for changing the state of the first activator (14) and a second portion (40) that comes into contact with the ring-shaped actuator (28) and moves it between its first and second positions, said switch arm (36) being pivotable about the rotation axis (A) and slidable in a direction perpendicular to the rotation axis between a first position operable to put the first activator (14) in the "off" state and the second activator (18) in the "off" state, a second position operable to put one of the first activator (14) or second activator (18) in the "on" state and the other of the first activator (14) or second activator (18) if the "off" state, and a third position operable to put the first activator (14) in the "on" state and the second activator (18) in the "on" state.

2. The rotating dual switching mechanism according to claim 1, wherein the ring-shaped actuator (28) has a radius substantially the same as the offset (B) of the activator (18) of said second switch (16) from said rotation axis (A).

3. The rotating dual switching mechanism according to claim 1, wherein the switch arm (36) has a third portion (42) operable in concert with the second portion (40) to move the ring-shaped actuator (28) between the first and second positions thereof.

4. The rotating dual switching mechanism according to claim 1, wherein the ring-shaped actuator (28) is spring-loaded in a direction parallel to the rotation axis (A) away from the second activator (18) of said second switch (16).

5. The rotating dual switching mechanism according to claim 4, wherein the switch arm (36) comprises a spring (42*a*, 42*b*) formed integrally therewith.

6. A rotating dual switching mechanism comprising:

a first switch (12) having a first activator (14) movable between an "on" state and an "off" state, said first activator (14) being located on a rotation axis (A);

a second switch (16) having a second activator (18) movable between an "on" state and an "off" state, said second activator (18) being offset (B) from said rotation axis (A);

a ring-shaped actuator (28) concentric with said rotation axis (A) and movable between a first position operable to put the second activator (18) in the "off" state thereof and a second position operable to put the second activator (18) in the "on" state thereof;

a switch arm (36) having a first portion (38) for changing the state of the first activator (14) and a second portion (40) for moving the ring-shaped actuator (28) between its first and second positions, said switch arm (36) being rotatable about the rotation axis (A) and movable between a first position operable to put the first activator (14) in the "off" state and the second activator (18) in the "off" state, a second position operable to put one of the first activator (14) or second activator (18) in the "on" state and the other of the first activator (14) or second activator (18) if the "off" state, and a third position operable to put the first activator (14) in the "on" state and the second activator (18) in the "on" state; and wherein the switch arm (36) is spring-loaded in a direction parallel to the rotation axis (A) towards the first activator (14) of said first switch (12).

7. A rotating dual switching mechanism comprising:

a first switch (12) having a first activator (14) movable between an "on" state and an "off" state, said first activator (14) being located on a rotation axis (A);

a second switch (16) having a second activator (18) movable between an "on" state and an "off" state, said second activator (18) being offset (B) from said rotation axis (A);

a ring-shaped actuator (28) concentric with said rotation axis (A) and movable between a first position operable to put the second activator (18) in the "off" state thereof and a second position operable to put the second activator (18) in the "on" state thereof;

a switch arm (36) having a first portion (38) for changing the state of the first activator (14) and a second portion (40) for moving the ring-shaped actuator (28) between its first and second positions, said switch arm (36) being rotatable about the rotation axis (A) and movable between a first position operable to put the first activator (14) in the "off" state and the second activator (18) in the "off" state, a second position operable to put one of the first activator (14) or second activator (18) in the "on" state and the other of the first activator (14) or second activator (18) if the "off" state, and a third position operable to put the first activator (14) in the "on" state and the second activator (18) in the "on" state; and wherein the ring-shaped actuator (28) comprises a spring formed integrally therewith.

* * * * *